US007311372B2

(12) United States Patent
Kubo

(10) Patent No.: US 7,311,372 B2
(45) Date of Patent: Dec. 25, 2007

(54) INK JET RECORDING APPARATUS

(75) Inventor: Tomoyuki Kubo, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 265 days.

(21) Appl. No.: 10/872,919

(22) Filed: Jun. 21, 2004

(65) Prior Publication Data

US 2004/0263554 A1 Dec. 30, 2004

(30) Foreign Application Priority Data

Jun. 30, 2003 (JP) ..... 2003-186589

(51) Int. Cl.
*B41J 29/377* (2006.01)

(52) U.S. Cl. ..... 347/18; 347/47; 347/57

(58) Field of Classification Search ..... 347/18, 347/47, 43, 57; 156/310; 438/122
See application file for complete search history.

(56) References Cited

U.S. PATENT DOCUMENTS 5,841,452 A * 11/1998 Silverbrook ..... 347/47
6,261,404 B1 * 7/2001 Baska et al. ..... 156/310
6,334,668 B1 1/2002 Isamoto ..... 347/57
6,631,966 B2 10/2003 Watanabe et al. ..... 347/18
6,682,171 B2 * 1/2004 Otsuka ..... 347/43
2002/0090760 A1 * 7/2002 Brand ..... 438/122

FOREIGN PATENT DOCUMENTS

JP 6297811 10/1994
JP 2000343690 12/2000
JP 2002144540 5/2002

* cited by examiner

*Primary Examiner*—Lam Son Nguyen
(74) *Attorney, Agent, or Firm*—Day Pitney LLP

(57) ABSTRACT

An ink jet recording apparatus including an ink jet recording head which ejects a droplet of an ink toward a recording medium, a driver circuit device which applies an electric voltage to the ink jet recording head so that the ink jet recording head ejects the droplet of the ink toward the recording medium, a carriage on which the ink jet recording head and the driver circuit device are mounted, and a first heat sink and a second heat sink which are mounted on the carriage such that the first and second heat sinks cooperate with each other to sandwich the driver circuit device and define an inner space.

22 Claims, 9 Drawing Sheets

INK JET RECORDING APPARATUS

The present application is based on Japanese Patent Application No. 2003-186589 filed Jun. 30, 2003, the contents of which are incorporated herein by reference.

BACKGROUND OF THE INVENTION

1. Field of the Invention

The present invention relates to an ink jet recording apparatus including an ink jet recording head and a driver circuit device which drives or operates the ink jet recording head.

2. Related Art Statement

There is known an ink jet recording apparatus which includes a carriage and an ink jet recording head mounted on the carriage and which reciprocates the carriage in directions perpendicular to a direction in which a recording medium is fed, while the ink jet recording head ejects droplets of ink toward the recording medium so as to record an image on the recording medium. This ink jet recording apparatus further includes a driver circuit device which is mounted on the carriage and which outputs a drive signal to drive the ink jet recording head so that the recording head ejects, based on the drive signal, the droplets of the ink toward the recording medium.

However, when the driver circuit device outputs the drive signal to the ink jet recording head, a great electric current momentarily flows in the driver circuit device, whereby a temperature of the driver circuit device abruptly increases. In addition, since the driver circuit device includes a plurality of driver elements corresponding to a plurality of ink ejection nozzles, there is a tendency that the total number, and density, of the driver elements increase. Thus, if the ink jet recording head continues, for a long time, ejecting concurrently respective droplets of ink from the nozzles, the temperature of the recording head significantly increases. This temperature increase may cause malfunction or instability of the driver circuit device, which in turn may cause unstable ejection of the ink from the recording head. Hence, there has been practiced to mount a heat radiator on the carriage, such that the heat radiator is held in contact with the driver circuit device, so that the heat generated by the driver circuit device is radiated by the heat radiator and accordingly the driver circuit device is cooled down.

Japanese Patent No. 2,927,141 discloses an invention in which an electric fan is used to radiate heat which is generated by a driver circuit device and is conducted by a heat pipe.

SUMMARY OF THE INVENTION

However, if the ink jet recording apparatus employs the above-indicated high-performance heat radiator (i.e., the electric fan and the heat pipe), the production cost of the recording apparatus increases. In addition, since the cooling device, i.e., the heat radiator is complicated, the size of the ink jet recording apparatus increases and the assembling of the same needs more time and labor.

It is therefore an object of the present invention to provide an ink jet recording apparatus which is freed of at least one of the above-identified problems. It is another object of the present invention to provide an ink jet recording apparatus which can enjoy a simple construction, can be easily assembled, and can efficiently radiate heat generated by a driver circuit device.

According to a first aspect of the present invention, there is provided an ink jet recording apparatus, comprising an ink jet recording head which ejects a droplet of an ink toward a recording medium; a driver circuit device which applies an electric voltage to the ink jet recording head so that the ink jet recording head ejects the droplet of the ink toward the recording medium; a carriage on which the ink jet recording head and the driver circuit device are mounted; and a first heat sink and a second heat sink which are mounted on the carriage such that respective one ends of the first and second heat sinks are connected to each other and respective other ends of the first and second heat sinks cooperate with each other to sandwich the driver circuit device, and such that the first and second heat sinks cooperate with each other to define an inner space having a substantially rectangular parallelepiped shape.

In the ink jet recording apparatus according to the first aspect of the present invention, the heat generated by the driver circuit device is conducted to both the first and second heat sinks. Since respective opposite ends of the two heat sinks that are opposite to the driver circuit device are connected to each other, the heat conducted to one of the two heat sinks is also conducted to the other heat sink. Thus, the heat is contacted with ambient air via a large surface or area and accordingly is efficiently radiated into the ambient air. In addition, since the two heat sinks are connected, at respective one ends thereof, with each other and sandwich, at the respective other ends thereof, the driver circuit device, the two heat sinks can be easily assembled with each other.

According to a second aspect of the present invention, there is provided an ink jet recording apparatus, comprising an ink jet recording head which ejects a droplet of an ink toward a recording medium; a driver circuit device which applies an electric voltage to the ink jet recording head so that the ink jet recording head ejects the droplet of the ink toward the recording medium; at least one ink tank which supplies the ink to the ink jet recording head; a carriage on which the ink jet recording head, the driver circuit device, and the at least one ink tank are mounted; and a first heat sink and a second heat sink which are mounted on the carriage such that respective one ends of the first and second heat sinks are connected to each other, and such that the first and second heat sinks cooperate with each other to sandwich the driver circuit device and define an inner space in which the at least one ink tank is provided.

In the ink jet recording apparatus according to the second aspect of the present invention, the heat generated by the driver circuit device is conducted to both the first and second heat sinks. Since respective opposite ends of the two heat sinks that are opposite to the driver circuit device are connected to each other, the heat conducted to one of the two heat sinks is also conducted to the other heat sink. Thus, the heat is contacted with ambient air via a large surface or area and accordingly is efficiently radiated into the ambient air. In addition, since the two heat sinks cooperate with each other to surround the ink tank, the two heat sinks and the ink tank can be mounted on the carriage in a compact manner. Thus, the present ink jet recording apparatus can be reduced in size.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
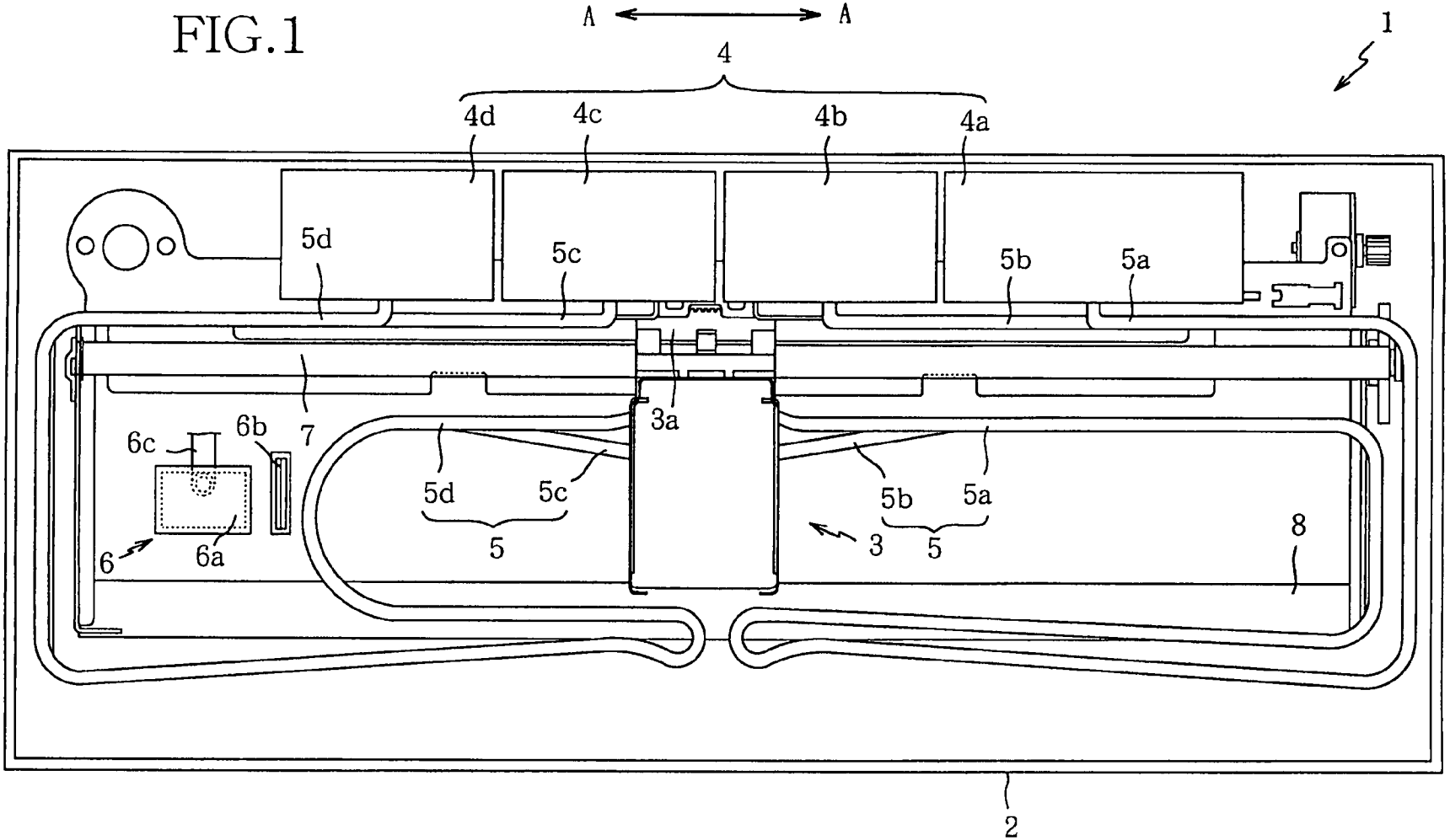
FIG. 1 is a plan view of an internal arrangement of an ink jet recording apparatus as a first embodiment of the present invention.

Hereinafter, there will be described a preferred embodiment of the present invention by reference to the drawings. FIG. 1 shows an ink jet recording apparatus 1 to which the present invention is applied. The ink jet recording apparatus 1 includes a main frame 2 which is formed of a fire-resistant plastic; a recording head unit 3 which is incorporated by the main frame 2 and which ejects respective droplets of four sorts of inks toward a recording medium such as a sheet of paper; an ink supply source 4 including four ink cartridges 4*a*, 4*b*, 4*c*, 4*d* which store the four sorts of inks, respectively, to be supplied to the recording head 3; four ink tubes 5 (5*a*, 5*b*, 5*c*, 5*d*) which connect between the four ink cartridges 4*a* through 4*d* and the recording head unit 3, respectively; and a purging device 6.

Figure 2:
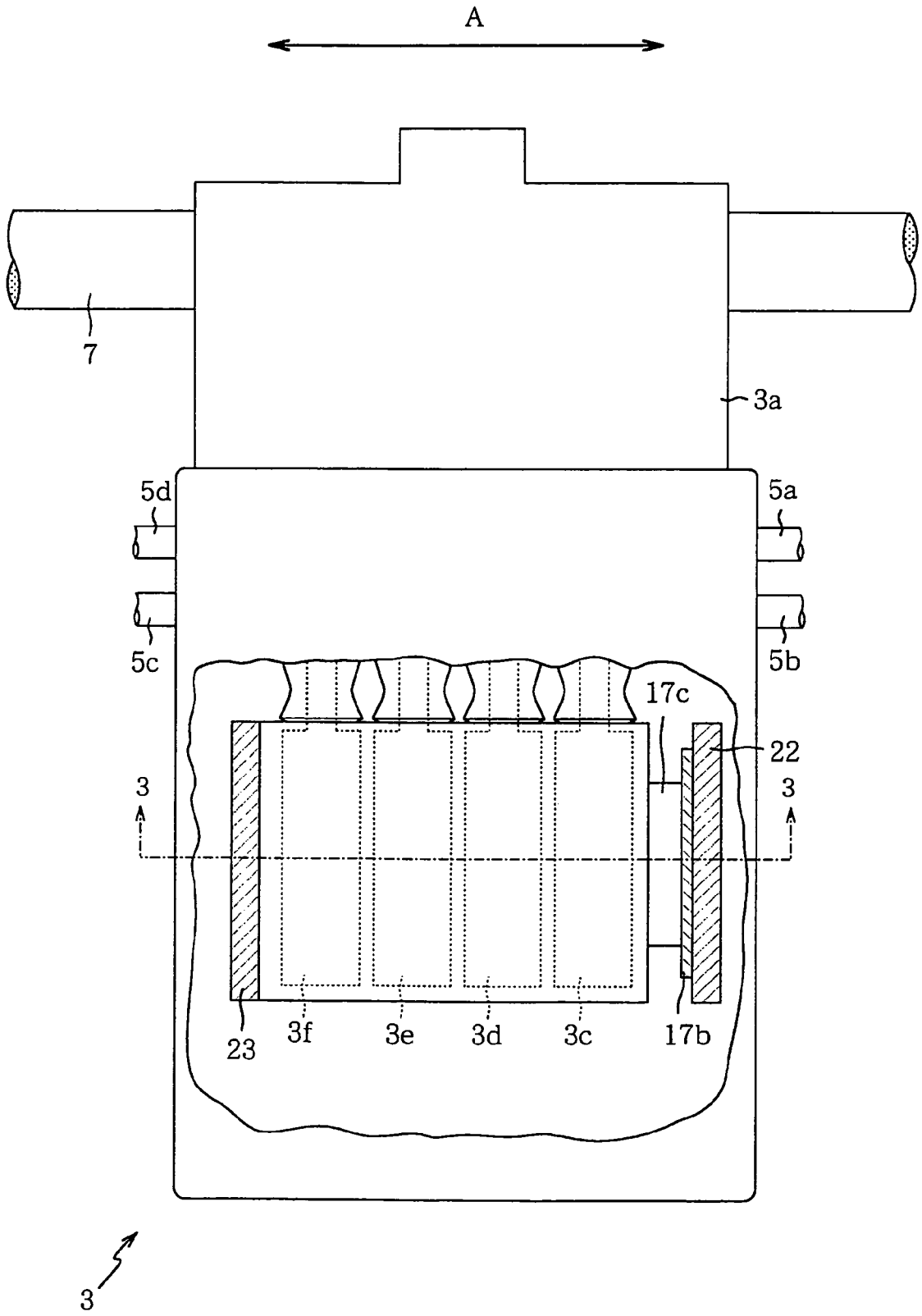
FIG. 2 is a plan view of an internal arrangement of a recording head unit as part of the first embodiment of the present invention.
Figure 3:
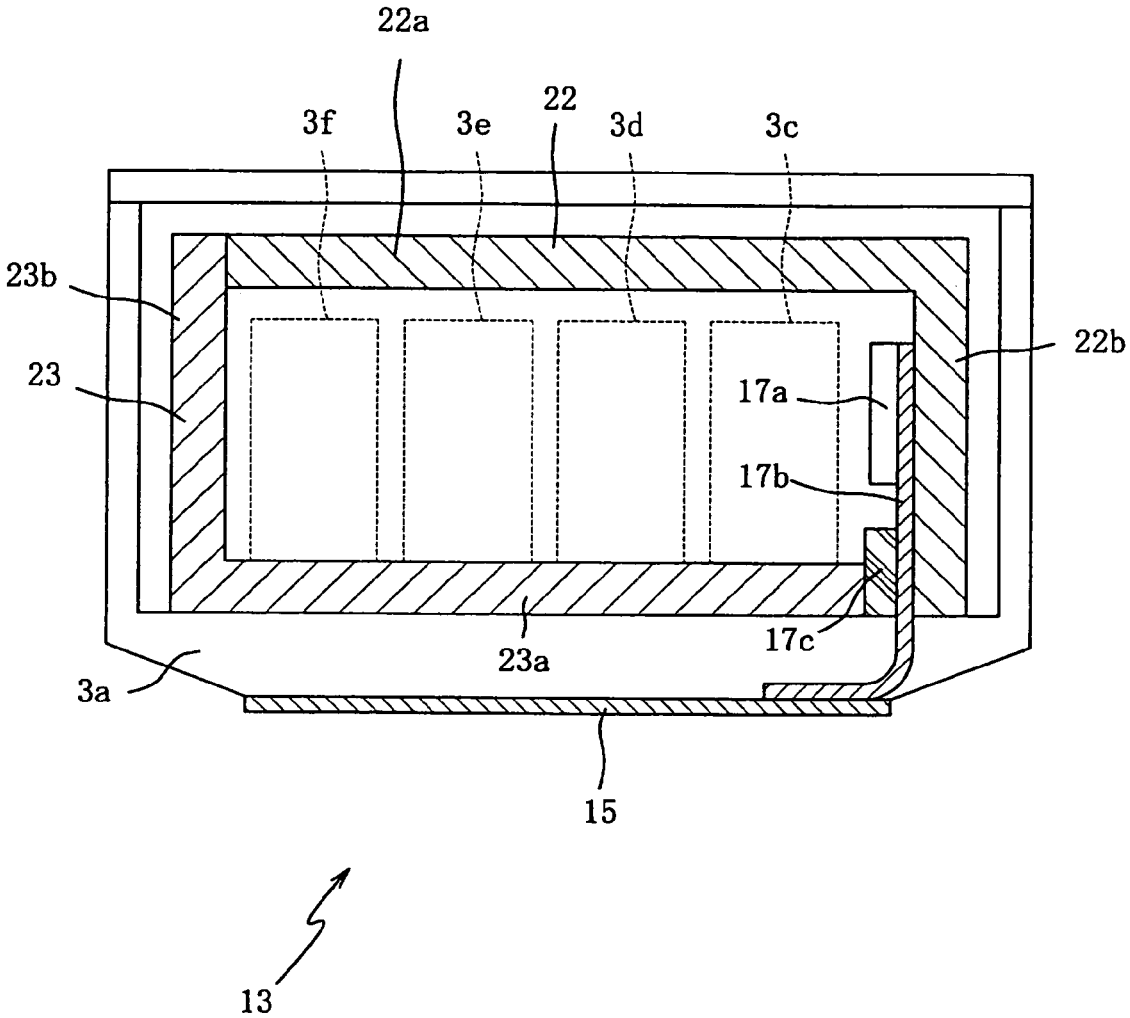
FIG. 3 is a cross-sectional view taken along 3-3 in FIG. 2.

As shown in FIG. 3, the recording head unit 3 is mounted on a carriage 13 which is reciprocated in lengthwise directions of the main frame 2, indicated by arrows, A, in FIGS. 1 and 2. The recording head unit 3 includes an ink jet recording head 15 which is provided, and exposed, in a lower surface of the carriage 13 and which ejects respective droplets of the four inks toward the recording medium. The recording head unit 3 will be described in detail, later, by reference to FIGS. 2 and 3.

Figure 8:
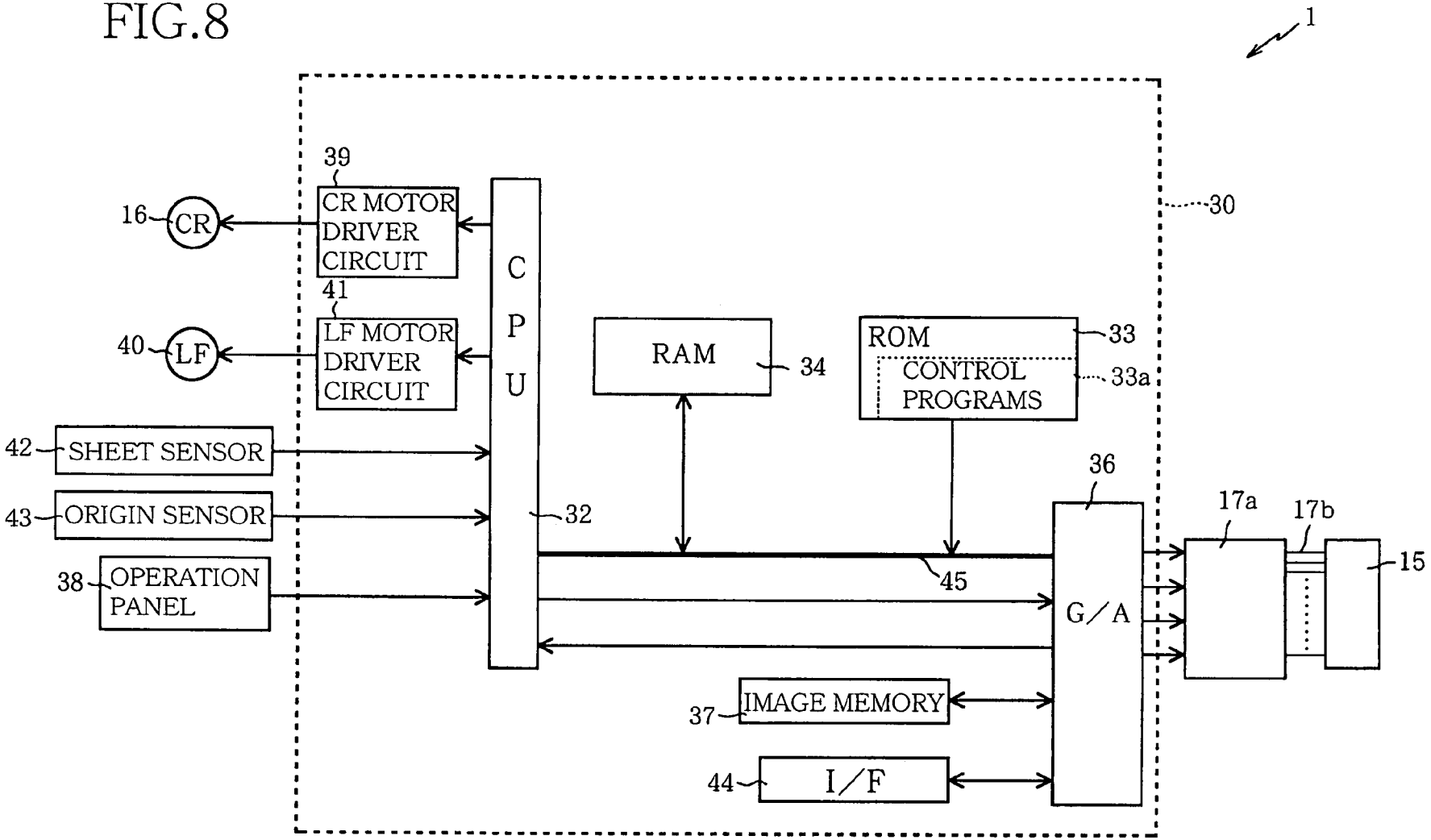
FIG. 8 is a diagrammatic view of an electric arrangement of the ink jet recording apparatus shown in FIG. 1.

As shown in FIGS. 1 and 2, a rear end portion of the carriage 13 slideably fits on a guide rod 7 extending parallel to the lengthwise directions of the main frame 2, and a front end portion of the carriage 13 is supported by a guide bar 8 extending parallel to the same directions. An endless belt, not shown, is fixed to the carriage 13, and is wound on pulleys, not shown, one of which is connected to a CR (carriage) motor 16 (FIG. 8). When the CR motor 16 is driven or rotated, the endless belt is circulated, so that the carriage 13 is reciprocated in the lengthwise directions of the main frame 2.

The ink supply source 4 includes the four ink cartridges 4*a* through 4*d* which are arranged in an array extending parallel to the lengthwise directions of the main frame 2. The four ink cartridges 4*a*, 4*b*, 4*c*, 4*d* liquid-tightly store a black ink, a yellow ink, a cyan ink, and a magenta ink, respectively. The four sorts of inks are supplied from the four ink chartridges 4*a* through 4*d*, via the four ink tubes 5*a* through 5*d*, to four buffer tanks (i.e., four ink tanks) 3*c*, 3*d*, 3*e*, 3*f* provided on the carriage 13, respectively, and then are supplied from the four buffer tanks 3*c* through 3*f* to four ink channels of the ink jet recording head 15, respectively.

The purging device 6 is provided in a left-hand end portion of the main frame 2, and performs a purging operation to recover an ink ejecting function of the ink jet recording head 15. The left-hand end portion of the main frame 2 where the purging device 6 is provided is beyond a recording range in which the ink jet recording head 15 records images on the recording medium, and is aligned with a retracted position to which the recording head 15 is retracted when the head 15 is not used.

The purging device 6 includes a suction cap 6*a* which contacts a nozzle supporting surface of the ink jet recording head 15 that supports a plurality of ink ejection nozzles, not shown, and cooperates with the nozzle supporting surface to define a gas-tight space; a suction pump, not shown, which sucks air from the gas-tight space and produces a negative pressure in the space; a suction tube 6*c* which connects between the suction cap 6*a* and the suction pump; and a wiper 6*b* which includes rubber sheets and wipes off the ink adhered to the nozzle supporting surface.

When the purging device 6 performs the purging operation, the carriage 13 is moved, by the CR motor 16, to a purging position, i.e., the retracted position. When the carriage 13 is moved to, and positioned at, the purging position where the suction cap 6*a* is opposed to the nozzle supporting surface of the ink jet recording head 15, a drive source, not shown, is driven or operated so as to cause the suction cap 6*a* to contact the nozzle supporting surface. Thus, the suction cap 6*a* and the nozzle supporting surface cooperate with each other to define the gas-tight space in which the ink ejection nozzles are exposed. In this state, the suction pump is operated to apply suction to the gas-tight space via the suction tube 6*c* and thereby produce a negative pressure in the space. Consequently air bubbles and/or adhered inks are removed from the ink ejection nozzles, and thus the ink ejecting function of the ink jet recording head 15 is recovered.

After the purging operation is finished, the drive source is driven or rotated in a reverse direction so as to move the suction cap 6*a* away from the nozzle supporting surface of the ink jet recording head 15. In addition, a cam mechanism, not shown, is operated to cause the rubber sheets of the wiper 6*b* to contact the nozzle supporting surface, and the carriage 13 is moved a small distance so that the wiper 6*b* wipes off the ink adhered to the nozzle supporting surface. However, the purging device 6 may be replaced with a different device which applies a positive pressure to the inks from the side of the buffer tanks 3*c* through 3*f* and thereby removes the inks from the ink jet recording head 15.

Next, there will be described the recording head unit 3 as a first embodiment of the present invention, by reference to FIGS. 2 and 3. FIG. 2 is a cross-sectional view of an internal arrangement of the recording head unit 3, and FIG. 3 is a cross-sectional view taken along 3-3 in FIG. 2. As shown in FIGS. 2 and 3, the recording head unit 3 includes a box-like head holder 3*a* whose lower surface supports the ink jet recording head 15; the four buffer tanks 3*c*, 3*d*, 3*e*, 3*f* which are incorporated by the head holder 3*a*; and two heat sinks 22, 23 which cooperate with each other to surround the four buffer tanks 3*c* through 3*f*. Each of the two heat sinks 22, 23 is formed by bending a metallic sheet having a high thermal conductivity, e.g., an aluminum or copper sheet, so as to have a substantially L-shaped cross section as shown in FIG. 3, and the two heat sinks 22, 23 are assembled with each other such that respective large portions thereof extend parallel to each other and are opposed to each other, respective small portions thereof extend parallel to each other and are opposed to each other, and respective interior angles thereof are diagonally opposed to each other. Thus, the two heat sinks 22, 23 cooperate with each other to define an inner space having a substantially rectangular parallelepiped shape. An end portion of an upper large portion 22*a* of the first heat sink 22 and an end portion of a vertical small portion 23*b* of the second heat sink 23 are connected to each other, such that heat can be conducted between the two portions 22*a*, 23*b*; and an end portion of a lower large portion 23*a* of the second heat sink 23 and an end portion of a vertical small portion 22*b* of the first heat sink 22 cooperate with each other to sandwich a semiconductor IC (integrated circuit) 17*c* as a driver circuit device which drives the ink jet recording head 15, such that heat can be conducted from the semiconductor IC 17*c* to each of the two portions 23*a*, 22*b*. An adhesive having a high thermal conductivity is interposed between the respective to-be-connected ends of the respective portions 22*a*, 23*b* of the heat sinks 22, 23, and between the semiconductor IC 17*c* and each of the respective sandwiching ends of the respective portions 22*b*, 23*a* of the heat sinks 22, 23.

The semiconductor IC 17*c* is connected to a flexible wiring substrate 17*b*, and one end portion of the flexible wiring substrate 17*b* is connected to a carriage substrate 17*a*, and the other end portion of the same 17*b* is connected to the ink jet recording head 15. The semiconductor IC 17*c* converts a recording-data signal in the form of a serial signal supplied from a main control substrate 30 (FIG. 8), described later, into a parallel signal corresponding to the plurality of ink ejection nozzles, and additionally converts the parallel signal into a plurality of voltage signals to drive or operate a plurality of driver elements corresponding to the ink ejection nozzles. The carriage substrate 17*a* is electrically connected to the main control substrate 30 via a harness cable, not shown, when the recording head unit 3 is mounted on the carriage 13.

The four buffer tanks 3*c*, 3*d*, 3*e*, 3*f* are provided in the rectangular parallelepiped inner space defined by the two heat sinks 22, 23, and communicate with the ink jet recording head 15 through the thickness of the lower, large portion 23*a* of the second heat sink 23, so as to supply the four color inks to the recording head 15.

FIGS. 4 (4A, 4B, 4C, and 4D) and 5 (5A and 5B) show a second embodiment of the present invention that relates to such an ink jet recording apparatus which employs two recording head units 3 each of which ejects respective droplets of two color inks, i.e., both of which cooperate with each other to eject respective droplets of four color inks in total. The two recording head units 3 include respective head holders 3*a*, 3*a* each of which holds two heat sinks 22, 23 which cooperate with each other to surround corresponding two buffer tanks out of four buffer tanks 3*c*, 3*d*, 3*e*, 3*f*. As shown in FIGS. 5A and 5B, each of the two recording head units 3 includes an ink jet recording head 15, a semiconductor IC 17*c*, a flexible wiring substrate 17*b*, and a carriage substrate 17*a*. More specifically described, each of the two head holders 3*a* holds the ink jet recording head 15 to which the flexible wiring substrate 17*b* is connected, and the two heat sinks 22, 23 are assembled with each other such that the semiconductor IC 17*c* is sandwiched by respective end portions of the two heat sinks 22, 23, like in the first embodiment shown in FIG. 3. However, in the second embodiment, an upper portion 22*a* of the first heat sink 22 and a vertical portion 23*b* of the second heat sink 23 are connected to each other by a screw 25. FIG. 4C is a front elevation view of one of the two identical recording head units 3; and FIG. 4D is a side elevation view of the same.

Figure 4B:
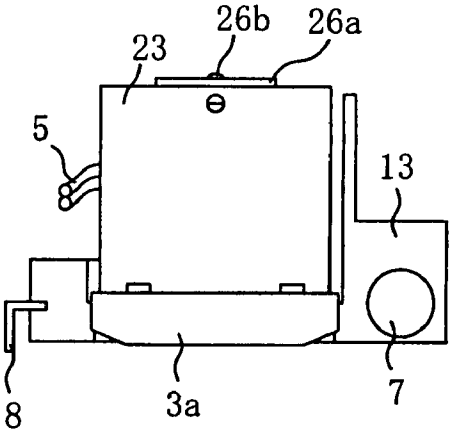
FIGS. 4A, 4B, 4C, and 4D are views of two recording head units as part of a second embodiment of the present invention.
Figure 4D:
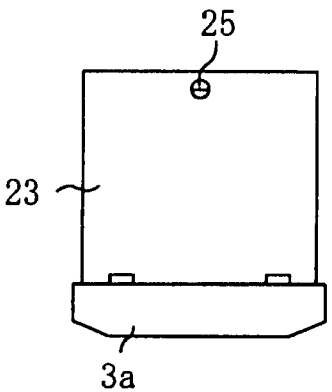
Figure 4A:
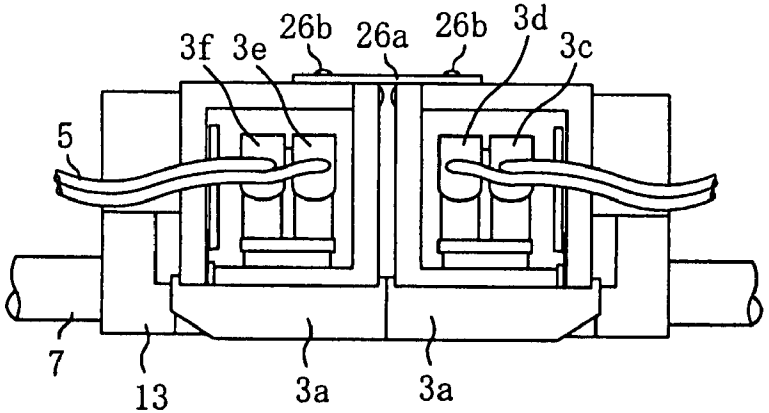
Figure 4C:
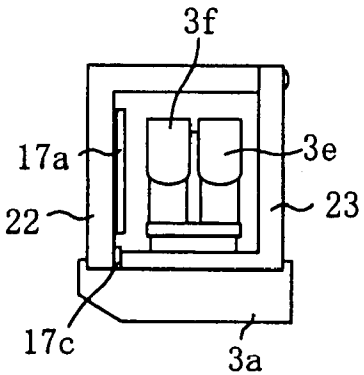
Figure 5A:
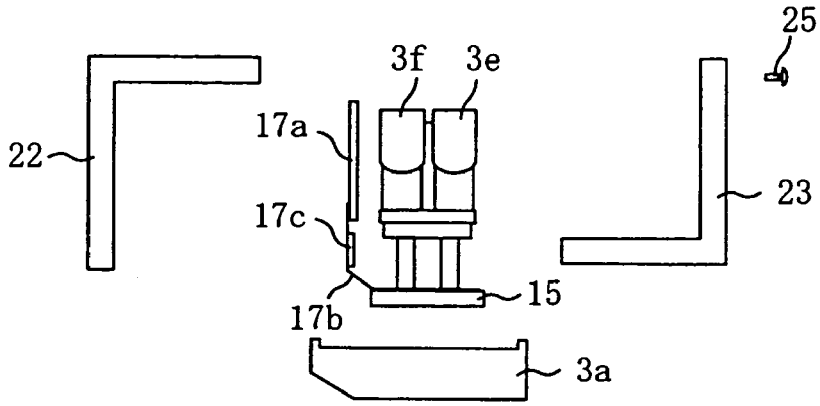
FIGS. 5A and 5B are views for explaining a manner in which each of the two recording head units shown in FIGS. 4A through 4D is assembled.
Figure 5B:
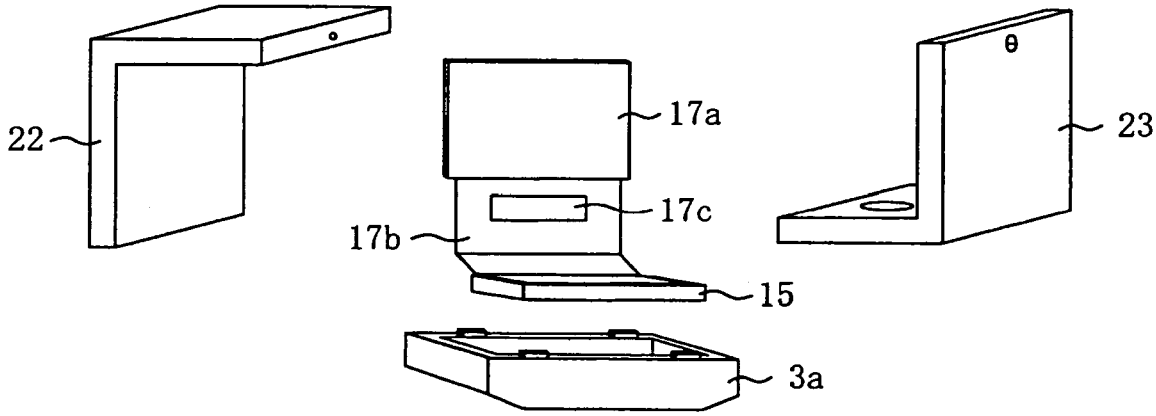
Figure 6A:
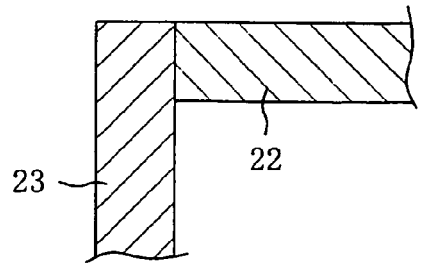
FIGS. 6A, 6B, 6C, 6D, and 6E are views for explaining respective manners in which two heat sinks are connected to each other.
Figure 6B:
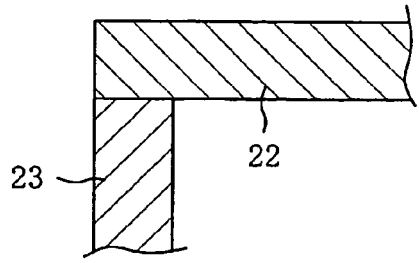
Figure 6C:
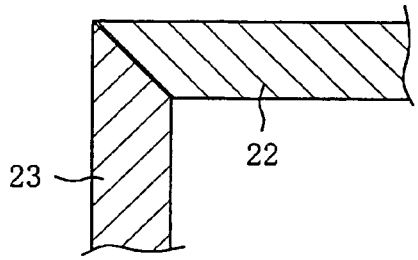
Figure 6D:
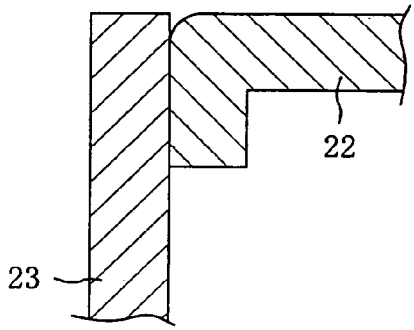
Figure 6E:
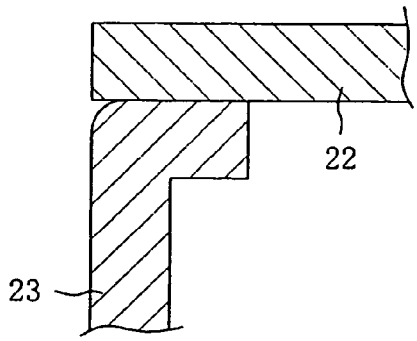

As shown in FIGS. 4A and 4B, the two recording head units 3 are mounted on the carriage 13, such that the four ink buffers 3*c* through 3*f* of the two units 3 that correspond to the four color inks, respectively, are arranged in an array. All the heat sinks 22, 23 of the two recording head units 3 are connected to each other via a connection member 26*a* which has a high thermal conductivity and which is fixed to the respective first heat sinks 22, 22 with respective screws 26*b*. Thus, heat can be conducted among the four heat sinks 22, 23 of the two recording head units 3. In the second embodiment, the semiconductor IC 17*c* of each one of the two recording head units 3 is provided at substantially the remotest position from the other unit 3, as shown in FIG. 4A. Thus, the heat produced by the each unit 3 is substantially most efficiently radiated.

Figure 9:
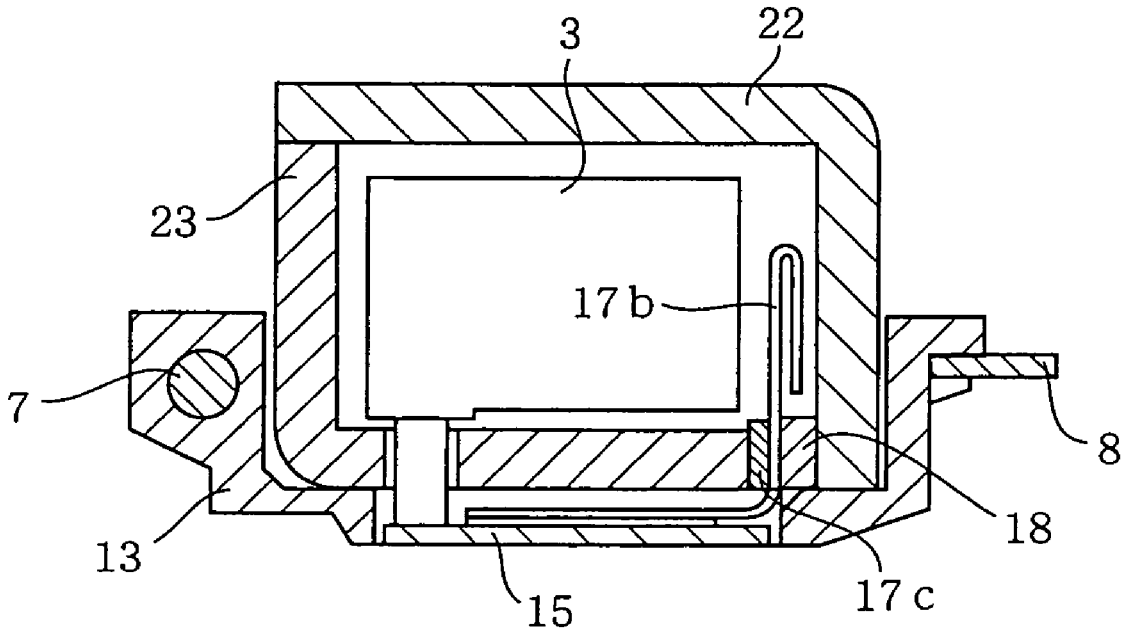
FIG. 9 is a cross-sectional view of a portion of another ink jet recording apparatus as a modified embodiment of the present invention.

In each of the first and second embodiments, the two heat sinks 22, 23 cooperate with each other to define the inner space that open at opposite ends thereof. Therefore, the heat produced by the semiconductor IC 17*c* is efficiently conducted to the heat sinks 22, 23, and then is efficiently radiated into inner and outer ambient air. In a modified embodiment, shown in FIG. 9, in which two heat sinks 22, 23 are provided such that two open ends of an inner space defined by the two heat sinks 22, 23 are opposite to each other in a direction parallel to the directions in which the carriage 13 is reciprocated, the heat generated by the semiconductor IC 17*c* is more efficiently radiated. In FIG. 9, reference numeral 18 designates a thermally conductive rubber member which biases the IC 17*c* and the flexible flat cable 17*b* toward the heat sink 23.

FIGS. 6A, 6B, 6C, 6D, and 6E show various manners in which the two heat sinks 22, 23 are connected to each other. In the first manner shown in FIG. 6A, an end surface of one 22 of the two heat sinks 22, 23 is connected to a side surface of the other heat sink 23. In the second manner shown in FIG. 6B, an end surface of one 23 of the two heat sinks 22, 23 is connected to a side surface of the other heat sink 22. In the third manner shown in FIG. 6C, respective end surfaces of the two heat sinks 22, 23 are inclined by 45 degrees, and the respective inclined end surfaces are connected to each other. In the fourth manner shown in FIG. 6D, an end portion of one 22 of the two heat sinks 22, 23 is bent by 90 degrees, and the bent end portion is connected to a side surface of the other heat sink 23. In the fifth manner shown in FIG. 6E, an end portion of one 23 of the two heat sinks 22, 23 is bent by 90 degrees, and the bent end portion is connected to a side surface of the other heat sink 22. In each of the fourth and fifth manners shown in FIGS. 6D and 6E, an area by which the two heat sinks 22, 23 are connected to each other is larger than that in each of the first to third manners shown in FIGS. 6A, 6B, and 6C.

Figure 7A:
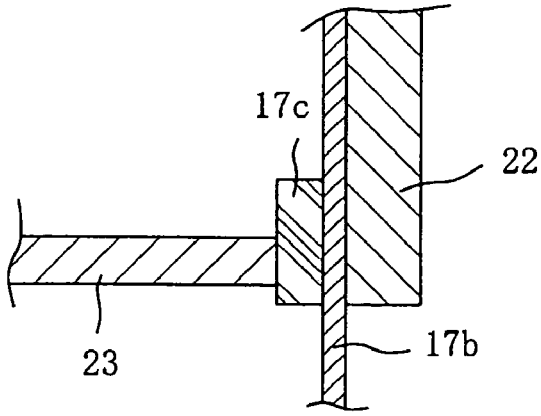
FIGS. 7A, 7B, and 7C are views for explaining respective manners in which two heat sinks cooperate with each other to sandwich a semiconductor IC (integrated circuit) and a flexible flat cable.
Figure 7B:
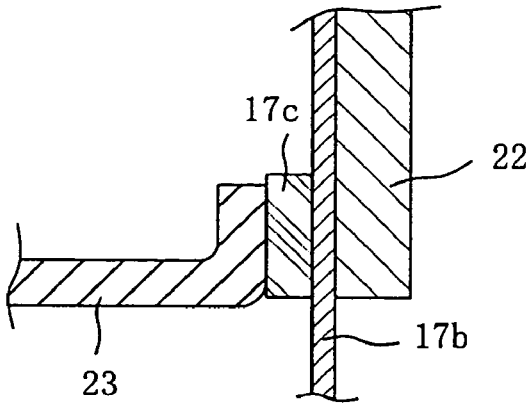
Figure 7C:
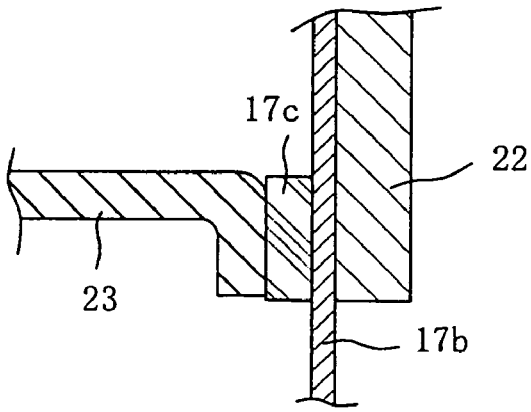

FIGS. 7A, 7B, and 7C show various manners in which the two heat sinks 22, 23 cooperate with each other to sandwich the semiconductor IC 17*c* as the driver circuit device. In the first manner shown in FIG. 7A, a side surface of the heat sink 22 is connected to the flexible wiring substrate 17*b* to which the semiconductor IC 17*c* is electrically connected, and an end surface of the heat sink 23 is connected to a surface of the IC 17*c* that is opposite to the substrate 17*b*. In the second manner shown in FIG. 7B, the heat sink 22 is connected to the flexible wiring substrate 17*b* like in the first manner, and an end portion of the heat sink 23 is bent by 90 degrees and the bent end portion is connected to a surface of the IC 17*c* that is opposite to the substrate 17*b*. The third manner shown in FIG. 7C differs from the second manner shown in FIG. 7B, in that in the third manner, an end portion of the heat sink 23 is bent in an outward direction opposite to the inward direction in which the end portion of the heat sink 23 is bent in the second manner. In each of the second and third manners shown in FIGS. 7B and 7C, an area by which the heat sink 23 is connected to the IC 17*c* is larger than that in the first manner shown in FIG. 7A.

Next, there will be described an electric arrangement of the ink jet recording apparatus 1 constructed as described above, by reference to FIG. 8. The ink jet recording apparatus 1 is controlled by an electronic control device including the main control substrate 30 and the carriage substrate 17*a*. The main control substrate 30 includes a one-chip microcomputer (CPU) 32; a read only memory (ROM) 33 which stores various control programs that are implemented by the CPU 32, and various default data; a random access memory (RAM) 34 which temporarily stores various data; an image memory 37 which stores image data; and a gate array (G/A) 36.

The CPU 32 as an arithmetic unit carries out, according to control programs 33*a* pre-stored by the ROM 33, not only the above-described purging operation and but also other operations. In addition, the CPU 32 produces recording timing signals and resetting signals, and sends those signals to the G/A 36, described later. The CPU 32 is connected to an operation panel 38 through which a user inputs, e.g., a start command to start a recording operation; a CR motor driver circuit 39 which drives the CR motor 16 to move the carriage 13; an LF motor driver circuit 41 which drives an LF motor 40 to feed each sheet of paper as the recording medium; a paper sensor 42 which detects a leading end of each sheet of paper; and an origin sensor 43 which detects an origin position of the carriage 13. The CPU 32 controls respective operations of those elements 38, 39, 41, 42, 43.

The G/A 36 outputs, based on the recording-timing signals supplied from the CPU 32 and the image data stored by the image memory 37, recording data to record an image on the recording medium; a clock signal which is synchronized with the recording data; a latch signal; a parameter signal to produce a basic recording waveform signal; and an ejection timing signal having a prescribed period, and supplies those signals to the carriage substrate 17*a*. The carriage substrate 17*a* sends those signals to the semiconductor IC 17*c* via the flexible wiring substrate 17*b*, and the IC 17*c* drives the ink jet recording head 15 to eject droplets of inks toward the recording medium.

In addition, the G/A 36 stores, in the image memory 37, the image data supplied from an external device such as a computer via a centrointerface (I/F) 44. Moreover, the G/A 36 produces, based on centrodata supplied from e.g., a host computer via the I/F 44, a centrodata reception interrupt signal, and sends the signal to the CPU 32.

The G/A 36 and the carriage substrate 17*a* communicate with each other via the harness cable (not shown) connecting between the two elements 36, 17*a*. The CPU 32, the ROM 33, the RAM 34, and the G/A 36 communicate with each other via a bus line 45.

In each of the above-described first and second embodiments, the carriage 13 carries the four buffer tanks 3*c* through 3*f*, each as the ink tank, which supply the four inks to the one or two ink jet recording head or heads 15, and the first and second heat sinks 22, 23 cooperate with each other to surround the two or four buffer tanks. Thus, the two or four heat sinks 22, 23 and the four buffer tanks 3*c* through 3*f* can be compactly mounted on the carriage 13.

In each of the above-described first and second embodiments, the first and second heat sinks 22, 23 cooperate with each other to sandwich the semiconductor IC 17*c* as the driver circuit device or a heat generating portion, and the semiconductor IC 17*c* generates a large amount of heat. Thus, the heat generated by the IC 17*c* as the driver circuit device can be efficiently radiated.

While the present invention has been described in its preferred embodiments, it is to be understood that the present invention is not limited to the details of the above-described embodiments but may otherwise be embodied in various manners.

For example, in the above-described first embodiment shown in FIGS. 1 through 3, the respective one ends of the two heat sinks 22, 23 are connected to each other with the thermally conductive adhesive; and in the above-described second embodiment shown in FIGS. 4A through 4D and 5A and 5B, the respective one ends of the two heat sinks 22, 23 of each of the two recording head units 3 are connected to each other by the screw 25. However, in each of the first and second embodiments, the respective one ends of the two heat sinks 22, 23 may be connected to each other with a thermally conductive adhesive or a screw, or by soldering or welding, and the respective other ends of the two heat sinks 22, 23 may be connected to the semiconductor IC 17*c* in any of those manners.

In each of the above-described first and second embodiments, the two heat sinks 22, 23, each having the L-shaped cross section, are assembled with each other to define the inner space having the substantially parallelepiped shape, and cooperate with each other to radiate the heat generated by the semiconductor IC 17*c*. However, one of the two heat sinks 22, 23 may have a generally I-shaped cross section, and the other heat sink may have a generally U-shaped cross section. In the latter case, too, the two heat sinks 22, 23 are assembled with each other to define the inner space having the substantially parallelepiped shape, and accordingly can enjoy the same advantages as those of the first and second embodiments.

In each of the above-described first and second embodiments, the two heat sinks 22, 23 cooperate with each other to surround the four ink tanks 3*c* through 3*f*. However, the two heat sinks 22, 23 are not essentially required to surround any ink tanks.

In each of the above-described first and second embodiments, the two heat sinks 22, 23 may be modified to surround one or more replaceable ink tanks, i.e., ink cartridges.

It is to be understood that the present invention may be embodied with various other changes and improvements that may occur to a person skilled in the art, without departing from the spirit and scope of the invention defined in the appended claims.

What is claimed is:

1. An ink jet recording apparatus, comprising:

an ink jet recording head which ejects a droplet of an ink toward a recording medium;

a driver circuit device which applies an electric voltage to the ink jet recording head so that the ink jet recording head ejects the droplet of the ink toward the recording medium;

a flexible wiring substrate which is electrically connected, at a first portion thereof, to the ink jet recording head, is electrically connected, at a second portion thereof, to an external device, and is electrically connected, at a third portion thereof located between the first and second portions, to one of opposite surfaces of the driver circuit device, a carriage on which the ink jet recording head, the flexible wiring substrate and the driver circuit device are mounted; and a first heat sink and a second heat sink which are mounted on the carriage such that respective one ends of the first and second heat sinks are connected to each other and respective other ends of the first and second heat sinks cooperate with each other to sandwich the driver circuit device and the third portion of the flexible wiring substrate, and such that the first and second heat sinks cooperate with each other to define an inner space having a substantially rectangular parallelepiped shape, wherein the other end of the first heat sink contacts at least a portion of the third portion of the flexible wiring substrate, the other end of the second heat sink contacts at least a portion of an other of the opposite surfaces of the driver circuit device, and the ink jet recording head is provided outside the inner space defined by the first and second heat sinks.

2. The apparatus according to claim 1, further comprising at least one ink tank which supplies the ink to the ink jet recording head and which is mounted on the carriage such that the at least one ink tank is provided in the inner space defined by the first and second heat sinks.

3. The apparatus according to claim 1, wherein the driver circuit device comprises a semiconductor integrated circuit and wherein the flexible wiring substrate is electrically connected, at the third portion thereof, to one of opposite surfaces of the semiconductor integrated circuit, the other end of the first heat sink contacts at least a portion of the third portion of the flexible wiring substrate, and the other end of the second heat sink contacts at least a portion of an other of the opposite surfaces of the semiconductor integrated circuit.

4. The apparatus according to claim 1, wherein at least one of (a) the respective one ends, and (b) the respective other ends, of the first and second heat sinks are connected to a corresponding one of (a) each other and (b) the driver circuit device, with a thermally conductive adhesive material.

5. The apparatus according to claim 1, wherein at least one of (a) the respective one ends, and (b) the respective other ends, of the first and second heat sinks are connected to a corresponding one of (a) each other and (b) the driver circuit device, by soldering.

6. The apparatus according to claim 1, wherein at least one of (a) the respective one ends, and (b) the respective other ends, of the first and second heat sinks are connected to a corresponding one of (a) each other and (b) the driver circuit device, by welding.

7. The apparatus according to claim 1, wherein at least one of (a) the respective one ends, and (b) the respective other ends, of the first and second heat sinks are connected to a corresponding one of (a) each other and (b) the driver circuit device, with at least one screw.

8. An ink jet recording apparatus, comprising:

an ink jet recording head which ejects a droplet of an ink toward a recording medium;

a driver circuit device which applies an electric voltage to the ink jet recording head so that the ink jet recording head ejects the droplet of the ink toward the recording medium;

a flexible wiring substrate which is electrically connected, at a first portion thereof, to the ink jet recording head, is electrically connected, at a second portion thereof, to an external device, and is electrically connected, at a third portion thereof located between the first and second portions, to one of opposite surfaces of the driver circuit device, at least one ink tank which supplies the ink to the ink jet recording head;

a carriage on which the ink jet recording head, the driver circuit device, the flexible wiring substrate and the at least one ink tank are mounted; and a first heat sink and a second heat sink which are mounted on the carriage such that respective one ends of the first and second heat sinks are connected to each other, and such that the first and second heat sinks cooperate with each other to sandwich the driver circuit device and the third portion of the flexible wiring substrate and define an inner space in which the at least one ink tank is provided, wherein the first heat sink contacts at least a portion of the third portion of the flexible wiring substrate, the second heat sink contacts at least a portion of an other of the opposite surfaces of the driver circuit device, and the ink jet recording head is provided outside the inner space defined by the first and second heat sinks.

9. The apparatus according to claim 8, wherein the driver circuit device comprises a semiconductor integrated circuit and wherein the flexible wiring substrate is electrically connected, at the third portion thereof, to one of opposite surfaces of the semiconductor integrated circuit, the first heat sink contacts at least a portion of the third portion of the flexible wiring substrate, and the second heat sink contacts at least a portion of an other of the opposite surfaces of the semiconductor integrated circuit.

10. An ink jet recording apparatus, comprising:

an ink jet recording head which ejects a droplet of an ink toward a recording medium;

a driver circuit device which applies an electric voltage to the ink jet recording head so that the ink jet recording head ejects the droplet of the ink toward the recording medium;

a flexible wiring substrate which is electrically connected, at a first portion thereof, to the ink jet recording head, is electrically connected, at a second portion thereof, to an external device, and is electrically connected, at a third portion thereof located between the first and second portions, to one of opposite surfaces of the driver circuit device, a carriage on which the ink jet recording head, the flexible wiring substrate and the driver circuit device are mounted; and a first heat sink and a second heat sink which are mounted on the carriage such that the first and second heat sinks cooperate with each other to sandwich the driver circuit device and the third portion of the flexible wiring substrate, wherein the first heat sink contacts at least a portion of the third portion of the flexible wiring substrate, and the second heat sink contacts at least a portion of an other of the opposite surfaces of the driver circuit device.

11. The apparatus according to claim 10, wherein respective one ends of the first and second heat sinks cooperate with each other to sandwich the driver circuit device.

12. The apparatus according to claim 10, wherein the first and second heat sinks cooperate with each other to define an inner space which has a substantially rectangular parallelepiped shape.

13. The apparatus according to claim 12, wherein each of the first and second heat sinks comprises a thermally conductive metal plate which is bent to have an L-shaped cross section, and wherein respective one ends of the first and second heat sinks are connected to each other and respective other ends of the first and second heat sinks cooperate with each other to sandwich the driver circuit device and the third portion of the flexible wiring substrate.

14. The apparatus according to claim 10, wherein the first and second heat sinks cooperate with each other to define an inner space, and wherein the apparatus further comprises at least one ink tank which supplies the ink to the ink jet recording head and which is mounted on the carriage such that the at least one ink tank is provided in the inner space defined by the first and second heat sinks.

15. The apparatus according to claim 10, wherein the first and second heat sinks cooperate with each other to define an inner space having opposite open ends, and wherein the first and second heat sinks are mounted on the carriage such that the opposite open ends of the inner space defined by the first and second heat sinks are opposite to each other in a direction parallel to directions in which the carriage is reciprocated.

16. The apparatus according to claim 10, wherein the ink jet recording head is provided at a position remote from the first and second heat sinks.

17. The apparatus according to claim 16, wherein the driver circuit device comprises a semiconductor integrated circuit and wherein the flexible wiring substrate is electrically connected, at the third portion thereof, to one of opposite surfaces of the semiconductor integrated circuit, the first heat sink contacts at least a portion of the third portion of the flexible wiring substrate, and the second heat sink contacts at least a portion of an other of the opposite surfaces of the semiconductor integrated circuit.

18. An ink jet recording apparatus, comprising:

at least two ink jet recording heads each of which ejects a droplet of an ink toward a recording medium;

at least two driver circuit devices each of which applies an electric voltage to a corresponding one of the at least two ink jet recording heads so that the one ink jet recording head ejects the droplet of the ink toward the recording medium;

at least two flexible wiring substrates each of which is electrically connected, at a first portion thereof, to a corresponding one of the at least two ink jet recording heads, is electrically connected, at a second portion thereof, to an external device, and is electrically connected, at a third portion thereof located between the first and second portions, to one of opposite surfaces of a corresponding one of the at least two driver circuit devices, a carriage on which the at least two ink jet recording heads, the at least two flexible wiring substrates and the at least two driver circuit devices are mounted; and at least one first pair of heat sinks and at least one second pair of heat sinks which are mounted on the carriage such that the heat sinks of the at least one first pair cooperate with each other to sandwich at least one first driver circuit device of the at least two driver circuit devices and the third portion of at least one first flexible wiring substrate of the at least two flexible wiring substrates, and the heat sinks of the at least one second pair cooperate with each other to sandwich at least one second driver circuit device of the at least two driver circuit devices and the third portion of at least one second flexible wiring substrate of the at least two flexible wiring substrates, wherein one of the heat sinks of the at least one first pair contacts at least a portion of the third portion of the at least one first flexible wiring substrate, and an other of the heat sinks of the at least one first pair contacts at least a portion of an other of the opposite surfaces of the at least one first driver circuit device, and wherein one of the heat sinks of the at least one second pair contacts at least a portion of the third portion of the at least one second flexible wiring substrate, and an other of the heat sinks of the at least one second pair contacts at least a portion of an other of the opposite surfaces of the at least one second driver circuit device.

19. The apparatus according to claim 18, wherein the heat sinks of the at least one first pair cooperate with each other to define at least one first inner space, and the heat sinks of the at least one second pair cooperate with each other to define at least one second inner space, and wherein the apparatus further comprises at least two ink tanks each of which supplies an ink to a corresponding one of the at least two ink jet recording heads and which are mounted on the carriage such that at least one first ink tank of the at least two ink tanks is provided in the at least one first inner space defined by the heat sinks of the at least one first pair and at least one second ink tank of the at least two ink tanks is provided in the at least one second inner space defined by the heat sinks of the at least one second pair.

20. The apparatus according to claim 18, further comprising at least one connection member which connects between (a) at least one of the heat sinks of the at least one first pair and (b) at least one of the heat sinks of the at least one second pair.

21. The apparatus according to claim 18, wherein the at least one second driver circuit device is mounted, on the carriage, at a substantially remotest position from at least one first ink jet recording head of the at least two ink jet recording heads hat is driven by the at least one first driver circuit device, and the at least one first driver circuit device is mounted, on the carriage, at a substantially remotest position from at least one second ink jet recording head of the at least two ink jet recording heads that is driven by the at least one second driver circuit device.

22. An ink jet recording apparatus comprising:

at least two ink jet recording heads each of which ejects a droplet of an ink toward a recording medium;

at least two driver circuit devices each of which applies an electric voltage to a corresponding one of the at lest two ink jet recording heads so that the one ink jet recording head ejects the droplet of the ink toward the recording medium;

a carriage on which the at least two ink jet recording heads and the at least two driver circuit devices are mounted; and at least one first pair of heat sinks and at least one second pair of heat sinks which are mounted on the carriage such that the heat sinks of the at least one first pair cooperate with each other to sandwich at least one first driver circuit device of the at least two driver circuit devices, and the heat sinks of the at least one second pair cooperate with each other to sandwich at least one second driver circuit device of the at least two driver circuit devices, wherein the at least one second driver circuit device is mounted, on the carriage, at a substantially remotest position from at least one first ink jet recording head of the at least two ink jet recording heads that is driven by the at least one first driver circuit device, and the at least one first driver circuit device is mounted, on the carriage, at a substantially remotest position from at least one second ink jet recording head of the at least two ink jet recording heads that is driven by the at least one second driver circuit device.

* * * * *